United States Patent [19]

Sears

[11] Patent Number: 4,979,743

[45] Date of Patent: Dec. 25, 1990

[54] GOLF CLUB GRIP

[76] Inventor: Gerard A. Sears, 2121 Dewey St., Santa Monia, Calif. 90405

[21] Appl. No.: 446,061

[22] Filed: Dec. 5, 1989

Related U.S. Application Data

[63] Continuation-in-part of Ser. No. 231,444, Aug. 12, 1988, abandoned.

[51] Int. Cl.[5] ..... A63B 53/14

[52] U.S. Cl. ..... 273/81 R; 273/186 A; 273/165

[58] Field of Search .... 273/67 R, 67 DA, 81 R–81.6, 273/73 J, 75, 193 R, 194 R, 77 R, 186 R, 186 A; 74/551.9; 81/177.1, 489

[56] References Cited

U.S. PATENT DOCUMENTS

| | | | |
|---|---|---|---|
| 2,023,131 | 12/1935 | Gibson | 273/80 R |
| 2,133,696 | 10/1938 | Hall | 273/81 R |
| 3,083,969 | 4/1963 | Bills | 273/80 B |
| 3,318,602 | 5/1967 | Kunihisa | 273/81 R |
| 3,638,943 | 2/1972 | Snau Waert | 273/73 J |
| 3,837,647 | 9/1974 | Jacques | 273/81 R |
| 4,067,573 | 1/1978 | Key | 273/81.4 |
| 4,090,711 | 5/1978 | Amato | 273/80 R |
| 4,116,440 | 9/1978 | Takeshima | 273/81.4 |
| 4,205,844 | 6/1980 | Gombas | 273/73 H |
| 4,252,319 | 2/1981 | Lorang | 273/186 A |
| 4,272,077 | 6/1981 | Spivey | 273/81 R |
| 4,736,949 | 4/1988 | Muroi | 273/73 J |
| 4,736,950 | 4/1988 | Doyle | 273/75 |
| 4,746,120 | 5/1988 | Mockovak | 273/81.5 |
| 4,811,947 | 3/1989 | Takatsuka | 273/73 J |

FOREIGN PATENT DOCUMENTS

| | | | |
|---|---|---|---|
| 53-123235 | 10/1978 | Japan | 273/73 J |

*Primary Examiner*—Edward M. Coven
*Assistant Examiner*—Sebastiano Passaniti
*Attorney, Agent, or Firm*—Beehler & Pavitt

[57] ABSTRACT

An improved golf putter is provided utilizing a golf grip connected to the shaft at a single point away from the vibrational nodes on the shaft within the grip. The grip is hollow and bell shaped so that both by shape and by composition of the matter of the grip, resonance or ringing of the grip is enhanced. A lower portion of the grip flares outwardly in the open bell shape not only to enchance resonance but also to provide a hard surface of enlarged diameter in contact with the fingers and palms of the player. This bell shaped portion is the dominant portion which controls the stroke of the putter and therefore allows an improved sense of feel to the player from the impact of the ball. In addition, any disturbing torques which are applied to the players's hands are more easily resisted by means of the enlarged ball shaped grip diamter.

4 Claims, 2 Drawing Sheets

GOLF CLUB GRIP

RELATED APPLICATION

The present application is a continuation-in-part application of a copending application of the same title, Ser. No. 231,444, filed on Aug. 12, 1988 now abandoned.

BACKGROUND OF THE INVENTION

1. Field of the Invention

The invention relates to the field of sports equipment and in particular to grips for golf clubs or putters with improved tactile and acoustic feedback to the hands of the player.

2. Description of the Prior Art

It is well appreciated both by professional and amateur golfers that one of the most difficult aspects of the sport of golf is not the play of the ball from the tee or off the green, but putting. The difference of a winning or losing performance among even modestly talented golfers often ends up in the play on the green rather than elsewhere in the game.

The rules of the United States Golf Association, the governing body for the sport, do not permit adaptations to golf equipment which allow sophisticated feedback devices such as lasers, electronics, internal gyros and the like which could be exploited to ease or improve the use of a club. Thus, a player must sense or obtain feedback from his manipulation of the golf club largely through his natural senses of sight, hearing and feel without the aid of electronics.

In virtually all golf play situations, and in particular in putting, feedback received by the player is tactile and is transmitted through the club head, shaft and grip to the player's hands. Many modifications have been made to club designs relating to weight distribution within the club or through shaft flexibility. Examples of these can be seen in Lowell, "Golf Putter", U.S. Pat. No. 1,569,765 (1926); Atkinson, "Golf Swing Training Device", U.S. Pat. No. 3,428,325 (1969); Steiner, "Variable Golf Club", U.S. Pat. No. 3,070,370 (1962); Guzzle et al., "Golf Club", U.S. Pat. No. 4,189,144 (1980); Winters, "Golf Club Shaft", U.S. Pat. No. 1,994,556 (1935); and Mazzocco et al., "Golf Club having Adjustable Length Shaft", U.S. Pat. No. 4,674,746 (1987).

In addition to modifications in shaft design or club mass distribution, numerous modifications have been made to the golf club grip to either increase comfort, increase reliability of grip or to attempt to vary the feel or tactile feedback through the golf club by means of a specially designed grip. For example, see Serblin, "Golf Club Handle", U.S. Pat. No. 3,173,689 (1965); Takashima, "Golf Club Grip", U.S. Pat. No. 4,116,440 (1978); Duncan, Jr., "Golf Club Grip", U.S. Pat. No. 2,459,996 (1949); Armstrong, "Grip for Playing Clubs", U.S. Pat. No. 1,488,900 (1924); Jordy, "Golf Grip", U.S. Pat. No. 1,604,696 (1926); Taylor, "Golf Club Grip and Marker", U.S. Pat. No. 3,779,559 (1973); Lamkin et al., "Golf Club Grip for Shafts with Diametral Variations", U.S. Pat. No. 3,360,264 (1967), and Kunihisa, "Golf Club Having a Handle with Vibration Sensing Means", U.S. Pat. No. 3,318,602 (1967).

The last patent to Kunihisa reflects the conventional wisdom that one means of increasing the tactile feedback to a golf club in its impact with the golf ball is by providing a means of transmitting the vibration of impact through the club to the golfer's hands. Kunihisa utilizes a number of embodiments incorporating an interior vibration transmitting rod which has a tactile pad or element extending to the side of the club grip in contact with the golfer's hands or fingers. Vibrations are transmitted through a rod connected to the golf club head through the shaft to the contact pad in place against the golfer's hands or fingers. The theory is that this allows the golfer to feel the impact of the club with the ball with greater fidelity and amplitude and thus allows the golfer to make adjustments to optimize the stroke for impact force.

However, each or the prior art methods and devices either suffers from complexity which leads to its questionable acceptability to the rule-making organization for this sport or is simply ineffective to provide the player with an accurate sense of the impact with the golf ball.

The positioning of grips with respect to vibration nodes on a shaft in a sports racket is shown in Muroi, "Racket Frame Having a Particularly Positioned Grip", U.S. Pat. No. 4,736,949. In Muroi, the connection between the grip and the shaft is a node of the vibration with the remainder of the grip filled with a vibration damping foam. The purpose is to reduce the vibrations transmitted from the shaft into the grip, particularly those of higher harmonic frequencies. While this is believed to be effective in providing a more single tone or frequency of vibration which is sensed in the player's hand, the construction actually substantially attenuates the degree of vibrations which can be sensed even of the fundamental frequency.

Furthermore, even such attenuated vibrational frequency which is transmitted is totally transmitted to the player through the grip as tactile sensation with no other pathway or mechanism for sensible feedback.

Therefore, what is needed is a design unencumbered with complexity which may render it suspicious or unacceptable to rule-making bodies, but which is nonetheless effective to provide an accurate sensation of the nature of the impact of the club with the ball.

BRIEF SUMMARY OF THE INVENTION

The invention is an improvement in a grip for a golf putter held by a user's hand. The putter comprises in turn an head for impacting a golf ball and a shaft coupling the head to the grip. The improvement comprises a hollow grip for providing a handhold. A connection element connects the hollow grip to the shaft. Vibrational energy is coupled from the shaft through the connection element into the hollow grip. The hollow grip is generally bell shaped, and has a lower enlarged portion adapted for contact with distal portions of the user's hands. The hollow grip is made of hard resonant material so that vibrational energy coupled from the shaft through the connection element into the hollow grip causes vibrational ringing of the grip.

As a result, an acoustic feedback is provided to the player relating to the nature of impact of the golf putter with the golf ball.

At least one vibrational node is established on the shaft by impact of the golf putter with the golf ball. The connection element is coupled to the shaft at a position other than at the node.

The enlarged bell shaped portion comprises an element for resisting disturbing torques applied to the player's hands during stroke and impact of the golf ball, which disturbing torques twist the shaft off line and result in misdirected impact on the golf ball.

The bell shaped portion comprises an element for controlling the stroke of the golf putter. The element for providing control of the stroke of the golf putter comprises in turn an element for providing an enhanced sense of feel of the grip to more sensitive portions of the player's hands.

The invention is also characterized as an improvement in a golf putter having a club head. A shaft is connected to the club head, and a grip is connected to the shaft. The improvement comprises a bell shaped resonating portion of the grip for generating a ringing sensation upon impact of the club head with a golf ball.

As a result, enhanced feedback is provided to the player's hands in contact with the grip.

The grip is composed of a hard resonating material responsive to impact of the golf club with the golf ball to create ringing within the bell shaped portion. The grip is hollow and is provided without any internal filler. The bell shaped portion comprises an element for controlling stroke of the golf putter. The element for controlling the stroke of the golf putter comprises and element for for providing an improved sense of feel to the player's hand through impact of the club head with the golf ball.

The bell shaped portion of the grip comprises an element for generating an acoustical ringing when the golf club head impacts the golf ball. The nature of the acoustical ringing is determined by the nature of impact of the club head with the golf ball.

The invention is still further a golf club putter for impacting a golf ball comprising a club head. A shaft is coupled to the club head. A grip is coupled to the shaft. The grip is adapted for grasping by the player's hands. Impact of the golf ball with the shaft creates vibrational nodes along the shaft. The grip is coupled to the shaft at a point away from the node distal from the club head. The grip is hollow and adapted through shape and composition to acoustically ring in response to impact of the club head with the golf ball.

As a result, enhanced feedback is provided to the player.

The grip is cantilevered away from the shaft below the point of coupling between the grip and shaft. The shape of the grip is generally bell shaped having an upper portion of a first diameter and a lower portion of a larger diameter tapered smoothly into the upper portion to form a large open flared bell opening of the grip at the end of the grip proximal to the club head. The grip is characterized by composition of a hard resonant material. The enlarged bell shaped portion is adapted to provide the primary portion of the grip in contact with the fingers and palms of the player when the layer's hands grasp the grip.

The invention and its various embodiments are better visualized by now turning to the following drawings.

The invention and its various embodiments may be better understood by now turning to the following detailed description.

DETAILED DESCRIPTION OF THE PREFERRED EMBODIMENTS

An improved golf putter is provided utilizing a golf grip connected to the shaft at a single point above or apart from the vibrational nodes on the shaft within the grip. The grip is hollow and bell shaped so that both by shape and by composition of the matter of the grip, resonance or ringing of the grip is enhanced. A lower portion of the grip flares outwardly in the open bell shape not only to enhance resonance but also to provide a hard surface of enlarged diameter in contact with the fingers and palms of the player. This bell shaped portion is the dominant portion which controls the stroke of the putter and therefore allows an improved sense of feel to the player from the impact of the ball. In addition, any disturbing torques which are applied to the player's hands are more easily resisted by means of the enlarged ball shaped grip diameter.

Figure 1:
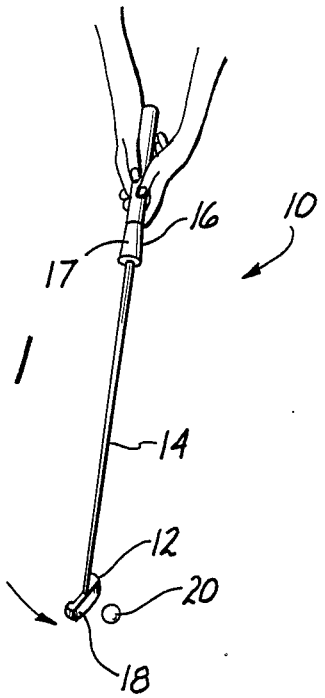
FIG. 1 is a perspective view of a golf club provided with a grip shown as held by the hands of a player.

Turn to FIG. 1 wherein a putter is illustrated. The putter, generally denoted by reference numeral 10, is comprised of a club head 12 connected by conventional means to a shaft 14 and these to a grip 16. Club head 12 and shaft 14 are conventional or may employ any design now known or later conceived. In the illustrated embodiment, for the sake of simplicity, putter head 12 is shown as a flat T-shaped conventional putter head having a flat surface 18 brought into contact with golf ball 20. Putter head 12 has an appropriately defined shaft receiving socket which is secured to shaft 14. Shaft 14 is a conventional putter shaft which may be solid or hollow and have any desired exterior configuration, tapering, cross section, step diameters or other structure as may be desired, now known or later devised. Furthermore, although in the illustrated embodiment the invention is described in connection with a putter for which its application is believed to be ideal, it is to be expressly understood that the invention could also be combined usefully in other types of golf clubs such as irons and woods and to other kinds of sports equipment used to impact an object such as tennis rackets, baseball bats, hockey sticks and the like.

Figure 2:
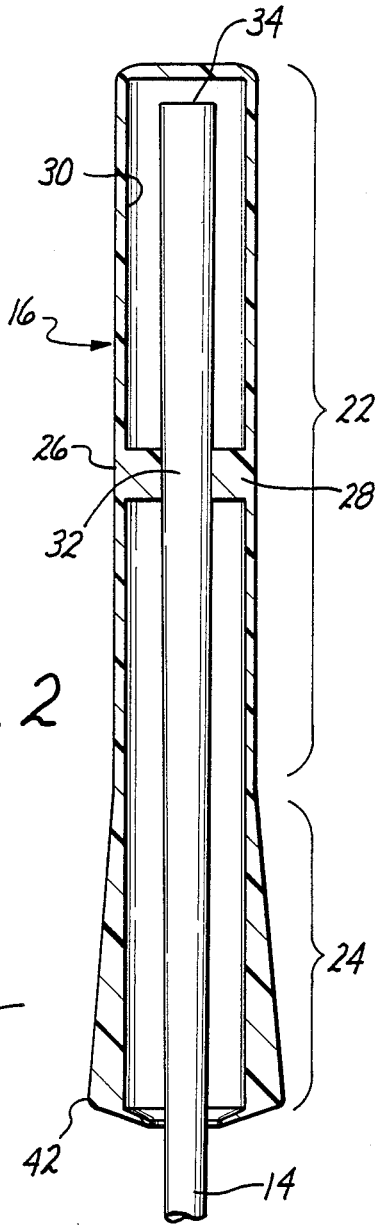
FIG. 2 is a longitudinal cross-sectional view of the upper portion of the golf club showing the structure of the grip and its attachment to the shaft.

Grip 16 is better illustrated in longitudinal cross-sectional view in FIG. 2. In the illustrated embodiment grip 16 is a generally hollow cylindrical member having an upper portion generally designated by reference numeral 22 and a lower tapered portion generally represented by reference numeral 24. Portion 22 has a generally cylindrical shape oriented in the axial direction defined by the length of shaft 14. Portion 24 tapers outwardly to form an increasing outward diameter the further that grip 16 extends down shaft 14 toward club head 12.

In the illustrated embodiment grip 16 is formed from aluminium and has its front side surface 26 knurled or roughened to enhance friction and grip with the player's hand. Grip 16 includes a flattened longitudinal segment 17 which is provided for finger alignment with grip 16 and ergonomic comfort. Grip 16 has an interior circumferential radial portion 28 which integrally extends from interior surface 30 of grip 16 and connects with shaft 14 at a predetermined position 32. As discussed below, position 32 is a nodal point on shaft 14. In the preferred embodiment, circumferential portion 28 is a radially extending, full circular flange which makes a complete circumferential contact with a predetermined portion of shaft 14 around nodal point 32. However, it is contemplated that circumferential portion 28 may alternatively include a plurality of radially extending arms forming a spider which connects grip 16 to shaft 14 and contacts shaft 14 in the region of nodal point 32 only at a corresponding plurality of surface segments. Still further, instead of an integrally extending radial connecting portion 28, a separate radially extending connecting member can be substituted and connected to shaft 14 and grip 16 by threading, welding, soldering, gluing or any other means of affixation or connection now known or later devised.

In any case, connecting flange 28 is the sole structural member which connects grip 16 to shaft 14, leaving grip 16 cantilevered about shaft 14 as depicted in the cross-sectional view of FIG. 2. In the illustrated embodiment, interior surface 30 of grip 16 is a cylindrical bore of a single interior diameter although it is entirely within the scope of the invention that the interior diameter of surface 30 may increase outwardly to correspond to tapered portion 24 of grip 16 in order to provide a thin walled grip 16 of substantially uniform thickness, if desired.

Figure 3:
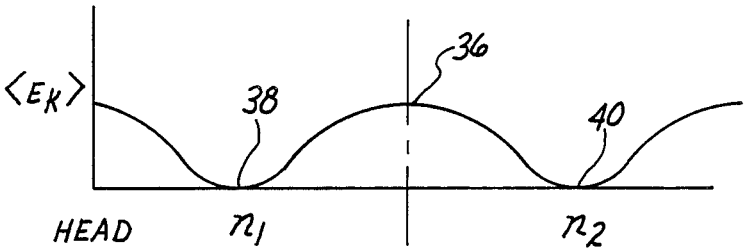
FIG. 3 is a highly diagrammatic view of the time averaged kinetic vibrational energy along the length of the shaft vibrating in the free-free mode at the moment of impact with the ball.

FIG. 3 diagrammatically illustrates the concept of nodal points of vibrational energy set up on shaft 14 when club 12 impacts ball 20. The vertical axis in FIG. 3 represents the time averaged kinetic energy of vibration at each point on shaft 14, while the horizontal axis represents the axial position on shaft 14 from head 12 of club 10 at the origin to grip end 34 at the opposing end of shaft 14. Line 36 of the graph of FIG. 3 is highly diagrammatic and does not depict the actual energy distribution, but is shown for the purposes of illustrating that two primary nodal points of zero or minimal vibrational energy are set up in standing positions along shaft 14 vibrating in the free-free mode at the time of impact with ball 20. A first nodal point 38 is established near the end of shaft 14 connected to head 12. Similarly, a second nodal point 40 is set up within shaft 14 near opposing end 34 of shaft 14. The exact positions of the nodal points along shaft 14 will vary, depending upon the length of the shaft, the diameter of the shaft, the shaft cross section, head configuration and other parameters which characterize club 10. Nodal points 38 and 40 can both be predicted theoretically and empirically determined for any given club desin through impact testing.

In the illustrated embodiment a golf club 10 having a T-type head 12 secured to a shaft 14 of uniform diameter of 9/16 inch at grip end and 33 inches long. Shaft 14 is affixed to a grip 16 of the configuration shown in FIG. 2 with the result that a nodal point 40 is established within the end proximal to grip 16 at a position approximately 6 inches from grip end 34 of shaft 14. In this particular club design the principal frequency of the free-free mode of vibration is approximately 43 Hz. It can be readily appreciated, however, that a spectrum of frequencies of various intensities are generated upon impact with ball 20 with certain frequencies being rapidly damped by virtue of the structure, geometry and material parameters of club 10, while other frequencies or a characteristic modal frequency contributes more significantly to the vibration energy distribution along the length of club 10.

In any case, attachment of grip 16 through radially extending portion 28 places the attachment of grip 16 to the point on shaft 14 wherein the minimal average vibrational energy is concentrated. The result is that the complex frequencies and harmonics which are set up by impact within club 10, which frequencies would otherwise be sensed and transmitted through grip 16 and to the player's hand, are substantially avoided or minimized by attachment of grip 16 only to the region proximate to nodal point 32. Thus, the player feels the forces transmitted from the impact of club 12 with ball 20 with as little disturbing, modifying or masking vibrations as possible. These vibrations typically are determined more by the club structure and parameters than by the impact with the ball. This allows the player a more accurate and straightforward means of tactile feedback with respect to ball impact and therefore allows the player to control the force of the impact of club 12 on ball 20 with greater accuracy and reliability.

Furthermore, the tactile transmission of the impact with ball 20 is transmitted through radial portion 28 into grip 16 with enhanced reliability and magnitude by virtue of the rigidity of grip 16 and an increased outer diameter for grip 16. In the illustrated embodiment the diameter of right cylindrical portion 22 of grip 16 is approximately 1.25 inch and increases therefrom to the enlarged tapered end 42 of tapered portion 24 to 1.50 inch. This allows the unmodified impact force which is transmitted through shaft 14 into grip 16 to be applied with a greater torque to the surface of the player's hands as well as allowing a greater surface area of contact for tactile sensation between grip 16 and the player's hands. Although in the preferred embodiment grip 16 is rigid and hard, it is also contemplated that other materials could be used to either comprise grip 16 or to provide appropriate coverings for modifying the tactile sensation of outer surface 26 or for providing some degree of cushioning if desired.

Finally, grip 16 in its cantilevered hollow configuration as shown in FIG. 2 tends to act as a bell or chime according to the impact force transmitted through shaft 14 into grip 16 even though grip 16 is held in the player's hands. Therefore, different impacts will tend to create a slightly different chime or ringing sound in grip 16 itself despite the fact that it is attached to nodal point 32 of shaft 14. This provides the additional enhancement of acoustic feedback in combination with tactile sensation to provide a cognitive feedback signal to the player concerning the nature of the impact that was actually made with the ball.

Therefore, the design of grip 16 substantially decouples grip 16 from the lateral vibrations of club head 12. When shaft deflection occurs, the impact of club head 12 with the ball is transmitted directly through shaft 14 to grip 16 with most of the resulting vibrations within shaft 14 not transmitted to grip 16. Therefore, the player primarily senses the impact and not the ensuing vibrational response of shaft 14.

Figure 4:
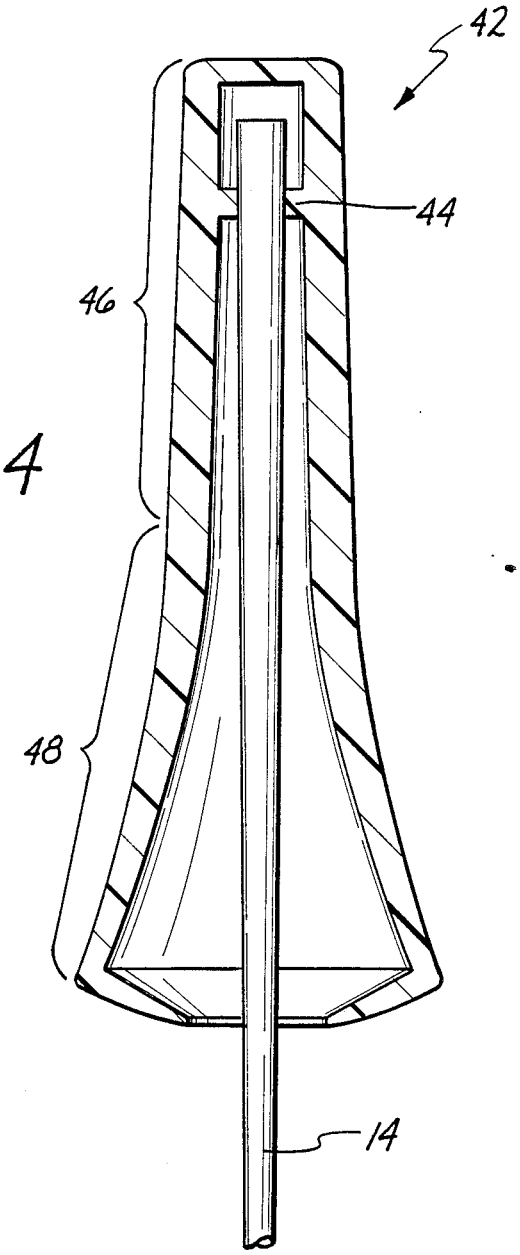
FIG. 4 is a cross-sectional view of an improved embodiment of the invention.

In another embodiment as best shown in FIG. 4, shaft 14 is connected to a handle, generally denoted by reference numeral 40 having a shape and composition similar to that shown and described in connection with FIG. 2, but where the connecting flange, in this case flange 44, is moved well off the nodal point 38 described in connection with FIG. 3 and is moved on or at least toward maximal point 36.

In any case, connecting flange 44 is moved to enhance or at least permit vibrations to be transmitted from the impact of the ball through shaft 14 into handle 42. Although the shaft vibrations are now transmitted with substantially less attenuation than that described in connection with the embodiment of FIG. 2, handle 42 now functions substantially as a bell to cause a ringing sound or resonant vibration upon impact. The ringing is enhanced if grip 42 is made of a hard material such as a metal or hard composite incorporating metal or glass fibers. In the embodiment of FIG. 3 a clear, ringing bell tone can be achieved if the golf club is suspended out of contact with the player's hand and the shaft 14 struck. Grip 42 then provides a sharp, clear, resonant ring. Of course, when the player places his hands on grip 42, the resonance of the ring is damped by the player's hands. Nonetheless, a distinguishable but muffled ring can still be detected and more importantly is acutely sensed in the player's hands, primarily the palms and fingers which are in contact with the lower bell shaped portion 48.

As before, grip 42 is comprised of a relatively narrow first portion 46 which is characterized by being generally cylindrical in configuration. A lower or flared portion 48 serves as a bell-shaped flange to enhance the acoustic or ringing response of grip 42 to an impact.

It has been found that the magnitude of the vibrations, and hence the quality of the acoustic ringing, is proportional or related to the magnitude of the impact of the putter head against the golf ball. Therefore, in addition to the tactile feedback provided through shaft 14 in grip 42, and more importantly an acoustic impact is provided which is believed in many cases to be a stronger and clearer means of feedback than that which could be provided through tactile vibration. The quality of the sound through experience provides an acoustic feedback to the player which permits him to judge the magnitude of the impact and hence the distance which the ball will roll.

Moreover, bell shaped portion 48 provides an enlarged diameter at the lower portion of grip 42. It has come to be appreciated that it is this portion of the grip which is contact with the user's lower hand and is dominant and controls the accuracy and nature of the putting stroke. The large diameter with an attendant large surface area places more of the sensitive portions of the hand, namely the fingertips and palm, into contact with grip 42. Therefore, together with the hard grip material, bell portion 48 provides an improved sense of feel compared to conventional putters of smaller diameter and softer grip material.

Still further, the enlarged diameter of bell portion 48 permits the player to better resist any disturbing torques during the stroke and impact which would otherwise tend to twist the putter face off line and result in the ball rolling in other than an intended direction. The ringing, together with the enlarged lower grip diameter, has surprising provided a substantially enhanced accuracy on the putting green to players who heretofore may have had insufficient control of the putting stroke to consistently perform within par. Quite unexpectedly, the feedback provided through the grip of FIG. 4 allows these same players to become consistent par players on the putting green.

Many modifications and alterations may be made by those having ordinary skill in the art without departing from the spirit and scope of the invention. Therefore, the illustrated embodiment must be understood as being shown only for the purposes of example and not by way of limitation of the invention as defined in the following claims.

I claim:

1. An improved golf club putter for impacting a golf ball and having a shaft with a handle portion extending axially inward from a first end and a club head attached to a second end opposite of said first end, said improvement comprising:

connection means for connecting a grip member to a region of said shaft on said handle portion proximate a nodal point, said nodal point attained through the concentration of minimal vibration energy near said nodal point, said vibrational energy created by the transmission of complex frequencies along said shaft when said club head impacts said golf ball;

wherein said grip member has an upper portion and a lower portion, said upper portion being generally hollow and having a generally uniform exterior first diameter and extending generally axially inward from said first end to said connection means, said lower portion being generally hollow and extending generally axially from said connection means toward said club head to lowermost end and being cantilevered from said shaft below said region of said connection means, said lower portion having an exterior second diameter larger than said first diameter which gradually and smoothly tapers into said upper portion to provide an outwardly flared opening at the lowermost end of said lower portion;

wherein said grip member and shaft are each formed of resonant material, whereby an acoustic feedback is provided when said club head strikes said golf ball.

2. The improvement of claim 1 wherein said lower portion comprises means for resisting disturbing torques transmitted through said grip member during stroke impact of said golf ball by said golf club, which disturbing torques tend to twist said shaft off-line and result in misdirected impact of said golf ball.

3. The improvement of claim 1 wherein said grip member provides control of the stroke of said golf putter by providing a lower portion of enlarged diameter adapted to provide a larger surface for enhanced tactile fingertip contact.

4. The improvement of claim 1 wherein said grip member is hollow.

* * * * *